340-552 SR

6/8/82 OR 4,334,214

United States Patent [19]

Satou et al.

[11] 4,334,214

[45] Jun. 8, 1982

[54] WARNING APPARATUS USING MICROWAVES

[75] Inventors: Shun Satou; Yuuji Jitsumatsu, both of Omiya, Japan

[73] Assignee: Yagi Antenna Co., Ltd., Tokyo, Japan

[21] Appl. No.: 160,495

[22] Filed: Jun. 18, 1980

[51] Int. Cl.[3] ..... G08B 13/18; G08G 1/01

[52] U.S. Cl. ..... 340/552; 332/9 T; 343/771; 375/23; 455/127

[58] Field of Search ..... 340/540, 552, 553; 343/5 PD, 767, 771; 332/9 T; 455/127; 375/23

[56] References Cited

U.S. PATENT DOCUMENTS

| | | | |
|---|---|---|---|
| 3,363,253 | 1/1968 | Ratkevich et al. | 343/771 |
| 3,496,568 | 2/1970 | Palumbo et al. | 343/771 X |
| 3,541,551 | 11/1970 | Bystrom, Jr. et al. | 340/552 X |
| 3,860,933 | 1/1975 | Terakawa et al. | 343/771 |
| 4,027,303 | 5/1977 | Neuwirth et al. | 343/5 PD X |
| 4,191,953 | 3/1980 | Woode | 340/552 |
| 4,219,802 | 8/1980 | Ceseri | 340/552 |

FOREIGN PATENT DOCUMENTS

| | | | |
|---|---|---|---|
| 1266344 | 3/1972 | United Kingdom | 340/552 |

OTHER PUBLICATIONS

"Installation & Alignment Manual for Microwave Security System, Racon Series 13000", by Racon, Inc., 1977.

*Primary Examiner*—John W. Caldwell, Sr.
*Assistant Examiner*—Joseph E. Nowicki
*Attorney, Agent, or Firm*—Oblon, Fisher, Spivak, McClelland & Maier

[57] ABSTRACT

A warning apparatus comprises a Gunn oscillator, a transmitting antenna, a receiving antenna, a detector, and a comparator which produces a detecting signal when the output signal from the detector is belowed a reference level. The warning apparatus further comprises a drive circuit for applying a rectangular pulse voltage to the Gunn oscillator, a band-pass filter allowing only a microwave with the transmitting frequency band of microwaves received by the receiving antenna to pass therethrough, and a signal generator for applying the reference signal, which changes in accordance with the output signal of the detector, to the comparator.

6 Claims, 19 Drawing Figures

WARNING APPARATUS USING MICROWAVES

BACKGROUND OF THE INVENTION

The present invention relates to a warning apparatus for detecting the presence or the absence of an intruding object by using microwaves.

There has been provided a warning apparatus with the combination of a transmitter and a receiver by using light beam, an ultrasonic wave or a microwave, in which when an intruding object appears between the transmitter and the receiver, a receiving signal level changes. Depending on the change of the receiving signal level, the warning apparatus recognizes that the intruding object is present. Of those warning apparatuses, the warning apparatus using the microwave has been widely used particularly in an important location, for the reason that it suffers from little erroneous detection with a high reliability, compared to those using the light beam and the ultrasonic wave. A detecting area of the warning apparatus is mainly determined by a shape of the microwave beam transmitted. In designing the detecting area of the apparatus, it is preferable to form so called electromagnetic fence in which it is wider in a vertical plane so as to prevent an intruder from passing over or under the microwave beam defining the detecting area and it is narrower in a horizontal plane so as to prevent obstructive object therearound such as trees sprayed by wind or passengers from entering the detecting area. Therefore, a desirable beam to be transmitted is an elongated fan beam. The conventional antenna commonly used to radiate the fan beam is a cut parabolic reflector antenna using a part of a parabolic reflector or a sectorial horn antenna. To transmit the desired fan beam, whose band width is over 30° in a vertical plane and below 8° in a horizontal plane, the antenna is necessarily enlarged in size, however. In the case of the parabolic antenna at 10 GHz, for example, the physical dimensions required are 30 cm for the diameter, and 20 cm for the radiator. Consequently, the radiation efficiency decreases. Also, in the case of the sectorial horn antenna, 30 cm or more is required for the length of the horn. In both cases, for this reason, those antennas are restricted in the location where they are installed. In connection with this, a large antenna is distinguished, and hence the nature, i.e. inconspicuousness, essentially required for the warning apparatus is lost of such an antenna is used.

SUMMARY OF THE INVENTION

Accordingly, an object of the present invention is to provide a warning apparatus using microwaves which is easily installed because of its small size and light weight, and which has a detecting area narrower in the horizontal plane and wider in the vertical plane.

The above object of the present invention is achieved by a warning apparatus using microwaves comprising: means for oscillating a microwave in accordance with an applied voltage; drive means for applying a pulse voltage to the oscillating means; a transmission antenna having a first slotted waveguide and a horn which are for radiating an output signal from the oscillating means; a receiving antenna having a second slotted waveguide and a horn; filter means for allowing only a microwave with a given frequency band of microwaves received by the receiving antenna to pass therethrough; means for detecting the output signal from the filter means; means for generating a reference signal according to the output signal from the filter means; and comparing means which compares the output signals from the detecting means and the reference signal generating means thereby to produce a detecting signal according to a difference therebetween.

The advantages of the present invention will be apparent from the following description taken in connection with the accompanying drawings, in which:

DETAILED DESCRIPTION OF THE PREFERRED EMBODIMENT

Figure 1:
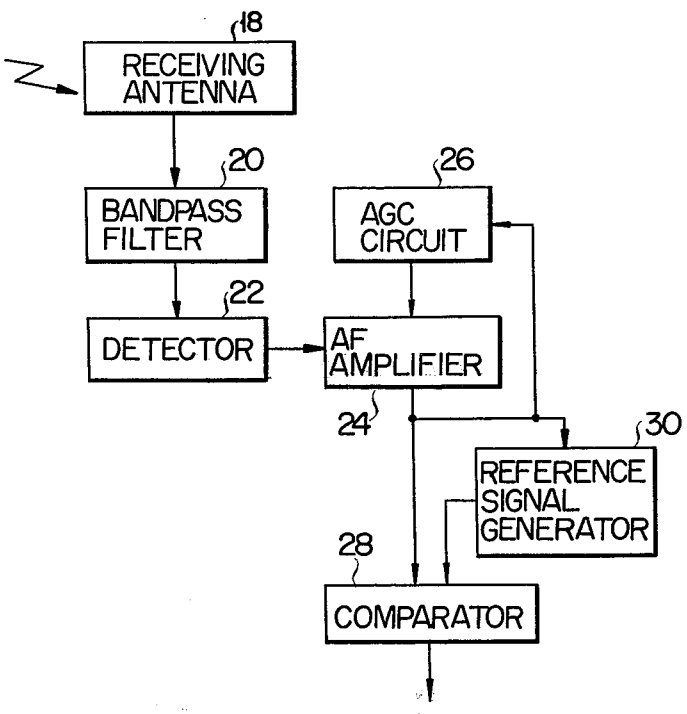
FIG. 1 is a block diagram of an embodiment of a warning apparatus using microwaves according to the present invention.

FIG. 1 is a block diagram of an embodiment of a warning apparatus using microwaves according to the invention. As shown, the output terminal of a pulse generator 10 for generating a pulse signal of approximately 1 KHz is connected to a pulse input terminal of a drive circuit 12. The drive circuit 12 produces a voltage signal in accordance with a pulse signal applied and is connected at the output terminal to the input terminal of a Gunn oscillator 14. The oscillating frequency from the Gunn oscillator 14 is about 10 GHz and the oscillating output thereof is radiated through a transmission antenna 16. Disposed on the beam axis of the transmission antenna 16 is a receiving antenna 18 of the same shape as that of the transmission antenna 16. The microwave radiated from the transmission antenna 16 is received by the receiving antenna 18. The receiving output signal from the receiving antenna 18 is applied through a band-pass filter 20 to a detector 22. The output signal from the detector 22 is applied to an audio frequency amplifier circuit 24. The output signal from the audio frequency amplifier circuit 24 is applied to a gain control terminal of the audio frequency amplifier circuit 24, by way of an automatic gain control (AGC) circuit 26. The output signal from the amplifier circuit 24 is applied to one of the input terminals of a comparator 28 and to the input terminal of a reference signal generator 30. The reference signal generator 30 has a time constant equal to that of the AGC circuit 26, and produces a reference signal in accordance with an input signal thereto but different in its value from the input signal. The reference signal is applied to the other input terminal of the comparator 28. When both the signals are coincident with each other, the comparator 28 produces a warning signal which in turn is applied to an alarm device (not shown) such as a buzzer.

Figure 2:
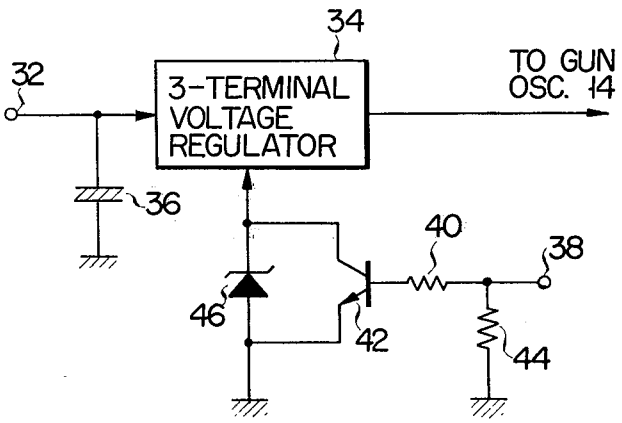
FIG. 2 is a circuit diagram of a drive circuit for a Gunn oscillator used in the warning apparatus.

FIG. 2 is a circuit diagram of the drive circuit 12. In the figure, a DC power source terminal 32 is connected to an input terminal of a three-terminal voltage regulator 34 which is commercially available. In the present embodiment, μPC-14305 manufactured by NEC (Nippon Electric Company, Ltd. in Japan) is used for the three-terminal voltage regulator 34. The input terminal of the regulator 34 is grounded through a smoothing capacitor 36. A pulse input terminal 38 to which the output signal from the pulse generator 10 shown in FIG. 1 is connected to the base of an NPN transistor 42 through a resistor 40 and grounded through a resistor 44. The emitter of the transistor 42 and the anode of a Zener diode 46 is grounded. The collector of the transistor 42 is connected to the cathode of the Zener diode 46 and the ground terminal of the regulator 34. The output signal from the regulator 34 is applied to the Gunn oscillator 14.

Figure 3:
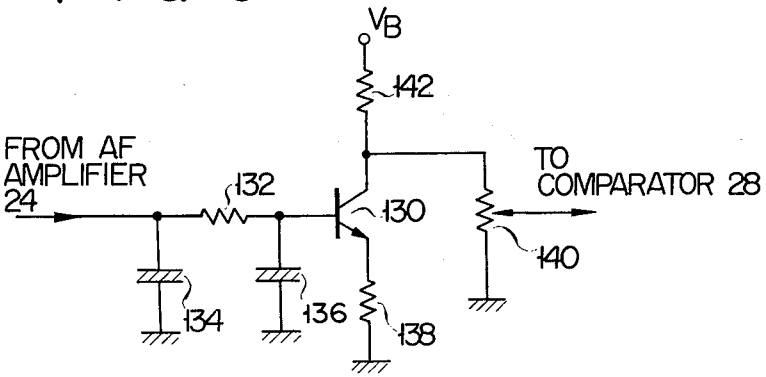
FIG. 3 is a circuit diagram of a reference signal generator used in the warning apparatus.

FIG. 3 is a circuit diagram of the reference signal generator 30. The output signal from the AF amplifier 24 is applied to the base of an NPN transistor 130 through a resistor 132. The input terminal of the generator 30 is grounded through a capacitor 134. The base of the transistor 130 is also grounded through a capacitor 136. The emitter of the transistor 130 is grounded through a resistor 138 and the collector of the transistor 130 is grounded through a variable resistor 140. A power source terminal $V_B$ is connected to the collector of the transistor 130. Output signal is applied to the comparator 28 from the movable terminal of the variable resistor 140.

The output signal from the AF amplifier 24 is shaped by the resistor 132 and capacitors 134 and 136. The DC component of it is applied to the base of the transistor 130.

Figure 4A:
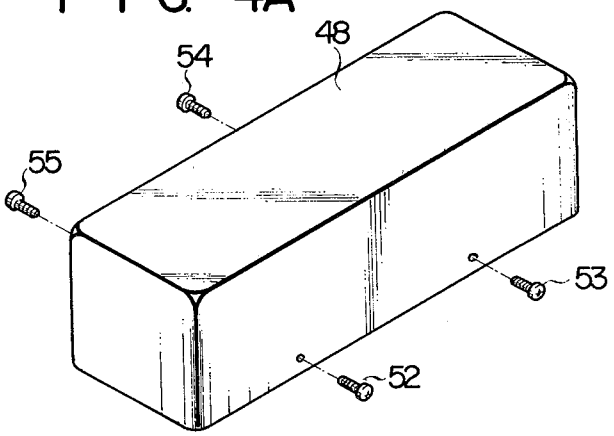
FIGS. 4A to 4C cooperatively show a perspective, exploded view of the transmitting section.
Figure 4C:
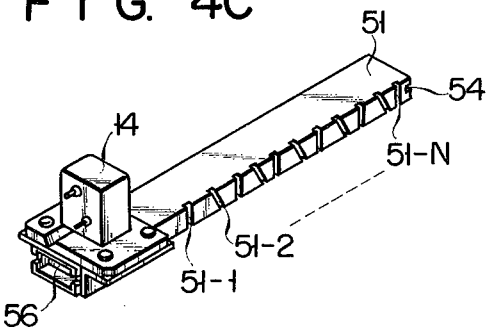
Figure 4B:
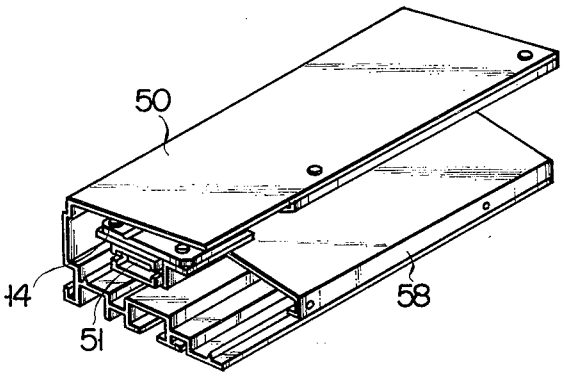

In the warning apparatus of the present invention, a transmitting system circuit and a receiving system circuit, respectively, are accommodated in a transmitting section and a receiving section. The structure of the transmitting section will be described referring to FIGS. 4A to 4C which cooperate to form a perspective, exploded view of the transmitting section. As shown in FIG. 4A, the transmitting section is covered with a plastic cover 48 moulded for protecting it from some ambient change such as rain and wind. The cover 48 is open at the lower end. Through the opening of the lower end of the cover 48, a support housing 50, having a cross section of a laid U-shape as shown in FIG. 4B, is inserted into the cover 48 and fixed thereto by means of screws 52 to 55. The housing 50, formed by the extrusion of aluminum, is vertical at the U-shaped opening face and is tapered at the coupling face opposite to the former, in order to facilitate the assembling of the support housing 50 into the cover 48. The bottom face of the support housing 50 has a groove of C shape so as to be easy in mounting a power feeding cable thereonto and in installing the transmitting section to an attachment. Assembled into the support housing 50 are a slotted waveguide 51 and the Gunn oscillator 14, as shown in FIG. 4B. The slotted waveguide 51, made of aluminum, has a rectangular cross section and a plurality of slots 51-1, 51-2, . . . , 51-N on one of the E planes, (narrower sides), thus serving as a transmitting antenna. Those slots are provided such that adjacent slots are slanted oppositely. Mounted to one end of the waveguide 51 as viewed longitudinally is a short-circuit plate 54. The intervals between the adjacent slots and between the slot and the short-circuit plate 54 are so selected that the microwave produced from the Gunn oscillator 14 oscillates by those and is radiated into free space with minimum loss. The H plane (wider side) at the other end of the waveguide 51 is connected to the Gunn oscillator 14 and is provided with a short-circuit plate 56 mounted thereto. Mounted to the waveguide 52, horn 58 gradually broadens its opening from the upper and lower H planes of the waveguide 51. The opening of the horn 58 is coincident with the opening of the support housing 50. The horn 58 made of aluminum, which is bent to form a sector, is mounted to the waveguide 51 by means of a suitable means such as adhesive or pins. The printing board of the circuit section upstands in the space of the rear side of the waveguide, although it is not shown.

Figure 5A:
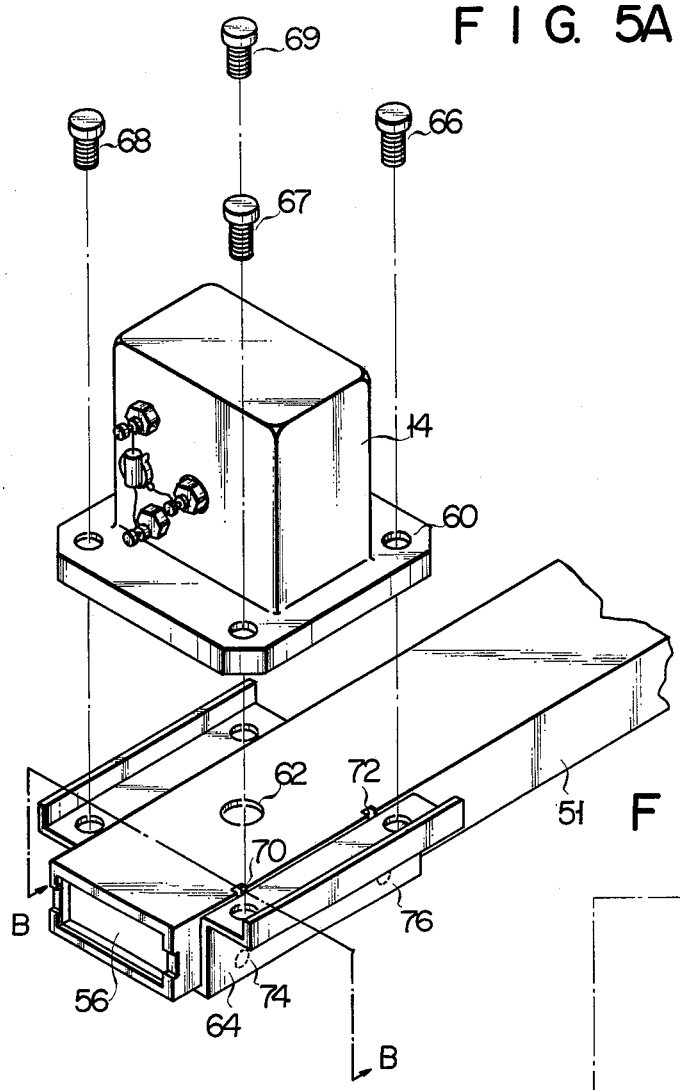
FIGS. 5A and 5B illustrate the coupling portion between a transmitting slotted waveguide and the Gunn oscillator.
Figure 5B:
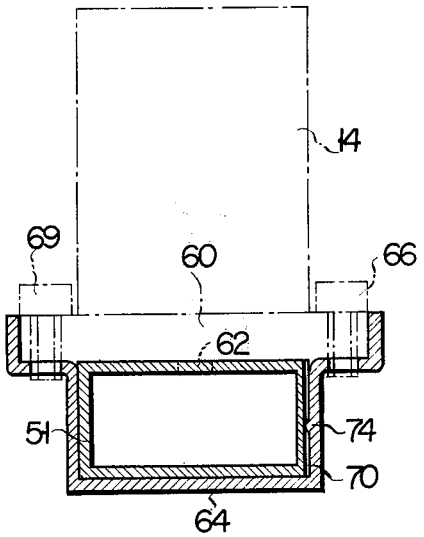

The details of the coupling portion between the Gunn oscillator 14 and the waveguide 51 are nextly described referring to FIGS. 5A and 5B. FIG. 5A is a perspective view of the coupling portion and FIG. 5B is a cross sectional view of the same. Generally, the Gunn oscillator 14 is provided with a flange 60 of which the size is given by its related standard. The flange 60 is provided with an opening (not shown) of the microwave signal output. A coupling hole 62, of which the shape, or circular in this example, is coincident with that of the opening of the flange 60, is formed on one of the H planes of the waveguide 51. The short-circuit plate 56 of aluminum, which is thin-plate-worked as previously mentioned, is fastened to the end portion of the waveguide 51 by means of an aluminum tape, for example. The coupling hole 62 is generally circular, even if the opening of the flange 60 is rectangular, for the reason that its manufacturing is easy, if it so done. The distance from the coupling hole 62 to the short-circuit plate 56 is preferably $\lambda g/4$ so that the portion of the waveguide corresponding to the distance acts as a resonator. $\lambda g$ corresponds to the wavelength within the waveguide 51. After the opening of the flange 60 is positioned with the coupling hole 62 of the waveguide 52, the Gunn oscillator 14 is coupled with the waveguide 51 by means of a mounting member 64 and tapping screws 66 to 69. The mounting member 64 has a hollowed portion to allow the waveguide 51 to be fitted therein and a flat surface in contact with the flange 60 of the Gunn oscillator 14. The end portion of the flat portion is orthogonally bent toward the flange 60 side to fit with the dimension of the flange 60, so as to allow the flange 60 to be fitted thereinto. In order to prevent the opening of the flange 60 from being dislocated from the coupling hole 61 of the waveguide 51, grooves 70 and 72 are vertically provided on one of the E planes of the waveguide 51. Projections 74 and 76 are formed on the inner surface of the mounting member 64 at the positions corresponding to the grooves 70 and 72. In assembling, the mounting member 64 is slided along the waveguide 51 from the lower side thereof so as to make the projections 74 and 76 engage with grooves 70 and 72, respectively. Then, the flange 60 is make to contact with the upper H plane of the waveguide 51. In the next step, the screws 66 to 69 are screwed to fasten the flange 60 to the mounting member 64 so that those squeeze the waveguide 51. In this way, both are coupled with one another. FIG. 5B shows a cross section taken along line B—B in FIG. 5A. The mounting member has not necessary the portion bent toward the flange 60 side.

Figure 6C:
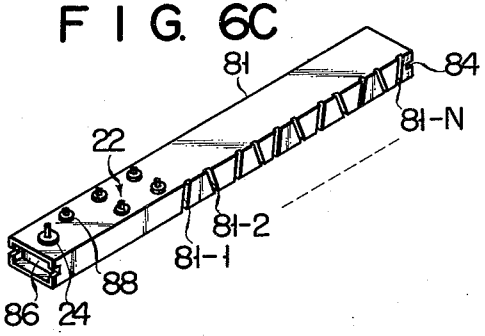
FIGS. 6A to 6C cooperatively show a perspective, exploded view of a receiving section of the warning apparatus.
Figure 6A:
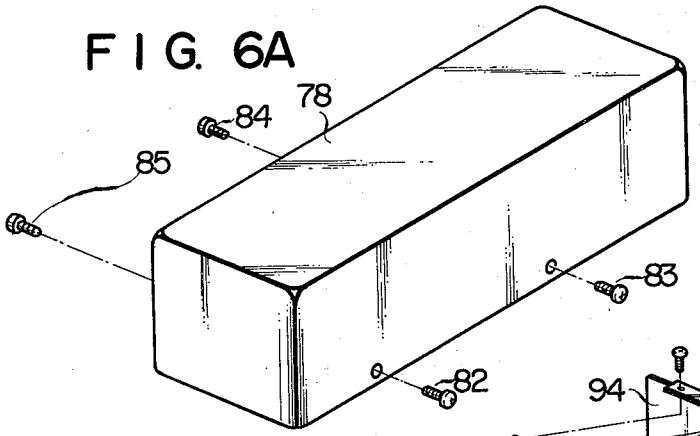
Figure 6B:
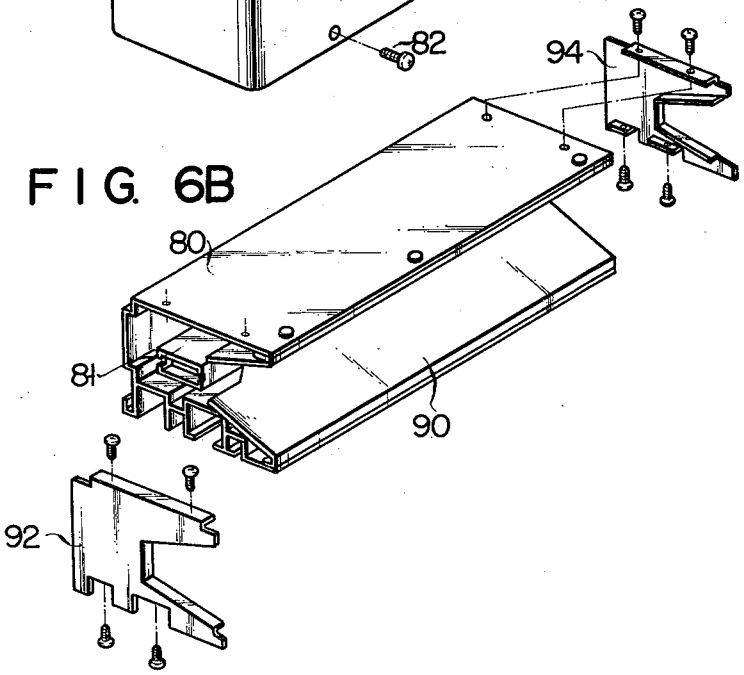

FIGS. 6A to 6C cooperatively show a perspective, exploded view of the receiving section. The structure of the receiving section will be described referring to those drawings. Like the transmitting section, the receiving section is also covered with a plastic cover 78, as shown in FIG. 6A. Within the cover 78, the support housing 80, as shown in FIG. 6B, is accommodated and fixed by means of screws 82 to 85. For ease of manufacturing, it is preferable that a plastic cover 78 and a support housing 80 of the receiving section, are the same as those of the transmitting section. The slotted waveguide 81 as shown in FIG. 6C is assembled into the support housing 80. A slotted waveguide 81 has the same cross sectional shape as that of the slotted waveguide 51 of the transmission section, and has a plurality of slanted slots 81-1, 81-2, . . . , 81-N in such a way that the adjacent slots are slanted oppositely. The slotted waveguide 81 is longer than the waveguide 51 for the transmission, having an extended portion containing therein the bandpass filter 22, and the detector 24. The mounting position of the detector 24 is fixed at a position where the detection is make most efficiently, that is, a position distanced from the short-circuit plate 86 by approximately $\lambda g/4$. A matching screw 88 for finely adjusting for attaining the impedance matching is further provided. Returning again to FIG. 6B, the waveguide 81 is provided with a horn 90 gradually expanding from the upper and lower H planes. The opening of the horn 90 coincides with the opening of the support housing 80. The horn 90 also is composed of an aluminum plate which is bent to form a sector, and is fixed to the waveguide 81 by means of a suitable fastening means, for example, adhesive, pins or the like. A printed board (not shown) of the circuit section is disposed upright in the space of the rear side of the waveguide 81. Accordingly, to prevent the microwave from unnecessary electro-magnetic wave or electronic noise to the circuit section, both sides of the support housing 80 are closed by side plates 92 and 94.

Figure 7:
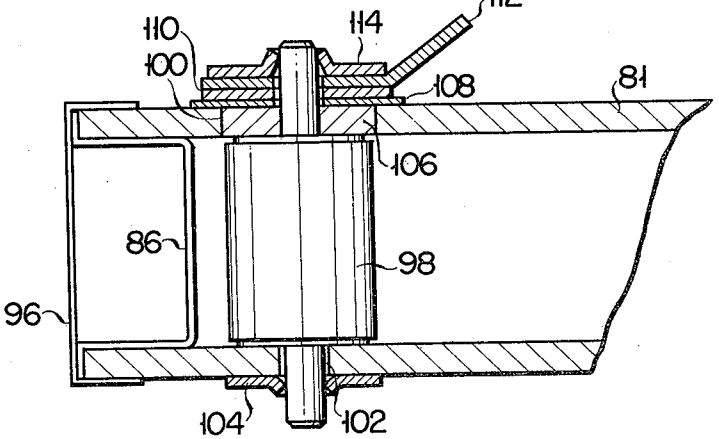
FIG. 7 illustrates a coupling portion between a receiving slotted waveguide and a detecting diode.
Figure 8A:
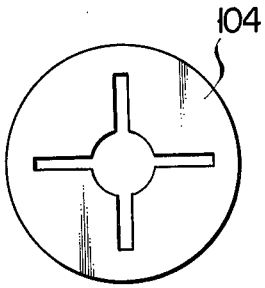
FIGS. 8A and 8B illustrate a spring plate and a terminal plate which are used for connecting the receiving slotted waveguide and the detecting diode.
Figure 8B:
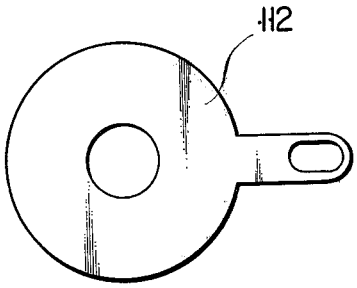

The detail of the coupling portion of the detector 24 with the waveguide 81 will be described referring to FIG. 7. FIG. 7 is a longitudinal sectional view of the waveguide 81. A short-circuit plate 86 is inserted into one end of the waveguide 81. The short-circuit plate 86 shaped like a hollowed short-circuit plate may be used. In practical use of the short-circuit plate, it is desirable to previously obtain an optimum shape of the short-circuit plate 86 experimentally and to manufacture it by the thin-plate-working. In assembling, the short-circuit plate 86 is inserted into one end of the waveguide 81 and fastened thereto by an aluminum tape 96. A diode contained in the detector 24 is shaped like a circular cylinder and is provided with pin-like electrodes projecting from the upper and lower ends thereof. As shown in FIG. 7, the waveguide 81 is provided at one of the H plane with an opening 100 to allow the diode 98 to pass therethrough, while is provided at the other H plane with an opening 102 to allow the electrode to pass therethrough. In assembling, the diode 98 is inserted into the waveguide 81 through the larger opening 100 and one of the electrodes thereof is projected through the opening 102. Then, the diode is fixed to the waveguide 81 by means of a metal spring plate 104 with a star-like slot at the central portion thereof as shown in FIG. 8A. A ring-like insulating member 106, which is for positioning the diode 98 and hence is not essential, is fitted into the opening 100. Multi-layered on the insulating member 106 are an insulating plate 108 of mica, a metal plate 110, a terminal plate 112 for taking out the detecting output signal, and a spring plate 114, same as the spring plate 104 of metal in this order. The insulating plate 108 and the metal plate 110 are each circular in shape and the terminal plate 112 is also circular, as shown in FIG. 8B, and is provided with a terminal for signal take-out on a part of it. The shape of the spring plate 114 has a slot at the center, as shown in FIG. 8A, and is for fixing the electrode of the diode 98. The metal plate 110 and the terminal plate 112 may be substituted by a suitable single means.

Figure 9A:
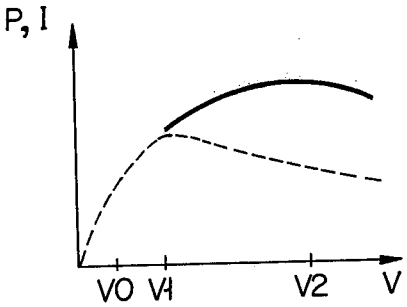
FIGS. 9A and 9B are graphical representations of a characteristic of the Gunn oscillator.
Figure 9B:
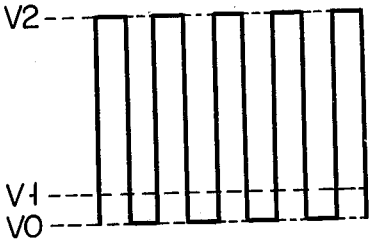

The operation of the above-mentioned embodiment will be described. Generally, the Gunn oscillator experiences an increased DC current flowing therethrough when a DC voltage is applied thereto. When it starts to oscillate, the DC current decreases slightly. A relation between the DC applied voltage V and the oscillation output P is illustrated by a solid line in FIG. 9A. As shown, the Gunn oscillator starts to oscillate at a point where $V=V1$, increases the oscillation output P with the increase of V to reach the maximum at a point $V=V2$, then gradually decreases it. When the Gunn oscillator is used as a continuous wave oscillator, it is used with application of a DC voltage $V=V2$ maximizing the oscillation output P. A relation between the DC applied voltage V and the DC current I flowing therethrough is illustrated by a broken line in FIG. 9A. When it is used as the oscillator for the warning apparatus, the oscillation output is pulse-modulated in order to increase the detecting sensitivity. In this case, if the rectangular pulse signal ranging from 0 to V2 is merely applied to the Gunn oscillator, the current intermittently flows through the Gunn oscillator. Since the Gunn oscillator surely responds to a repetitive frequency of approximately 1 KHz which is normally applied thereto, the Gunn oscillator is repetitively heated, so that the thermal impact is applied to the PN junction of the Gunn diode, thereby to reduce the life-time of the Gunn oscillator. For this reason, the voltage applied to the Gunn oscillator is preferably a rectangular pulse signal ranging from a voltage V0 slightly lower than the oscillation start voltage V1 to a voltage V2, or a voltage signal in which the rectangular wave ranging from V0 to V2 is superposed on the DC bias voltage V0, as shown in FIG. 9B. When such an applied voltage is used, the DC voltage V0 is always applied to the Gunn diode, so that the nearly constant current, as shown in FIG. 9A by a broken line, flows therethrough. The current continuously flows and is never reduced to zero. As a result, no thermal impact is applied to the PN junction and hence the life-time of the oscillator is not shortened. The drive circuit 12 for applying such a rectangular wave voltage to the Gunn oscillator 14 is the circuit shown in FIG. 2. In FIG. 2, the Zener voltage of the Zener diode 46 is so set that when a DC voltage is applied to the input terminal of the three-terminal voltage regulator 34, if the ground terminal of the regulator 34 is grounded, the voltage V0 appears at the output terminal of the regulator 34 and if the cathode of the Zener diode 46 is connected to the ground terminal of the regulator 34 and the anode of the diode 46 is grounded, the voltage V2 appears at the output terminal of the regulator 34. The regulator 36 is previously adjusted so as to operate in such a way. When the rectangular wave signal is applied to the pulse input terminal 38, the transistor 42 is turned on and off. As a result, the ground terminal of the regulator 34 is grounded or connected to the Zener diode 46. At this time, the regulator 34 produces the rectangular wave signal as shown in FIG. 9B. In response to such an applied voltage, the Gunn oscillator produces a microwave pulse signal modulated.

The microwave is radiated from the transmission antenna extended in a horizontal plane including the slotted waveguide 51, in the form of a fan beam with a narrow beam width as viewed in the horizontal plane. For example, when the oscillating frequency is about 10 GHz, the fan beam obtained is: the beam width is approximately 8° in the horizontal plane and approximately 30° in the vertical plane. Therefore, the detecting area of the warning apparatus takes the form of a longitudinally elongated fence. Further, the transmitting and receiving sections may be made small in size because the parabolic antenna or the sectorial horn antenna is not used. For example, this for about 10 GHz is 30 cm (width)×10 cm (height)×10 cm (depth). The conventional way to couple the oscillator with the waveguide is that a flange silver-brazed to the end surface of the waveguide is fixed to the flange of the oscillator by means of screws. For this reason, the waveguide can be made of brass or copper in consideration of a cost. When the oscillator is mounted through the mounting member to the H plane of the waveguide having the coupling hole, as shown in FIGS. 5A and 5B, the waveguide may be made of aluminum. The cost of manufacturing the waveguide is lowered since it is not necessary to provide the flange. If so done, the warning apparatus may be made light. For example, the weight of the transmitting or receiving section is approximately 2 Kg.

Figure 10A:
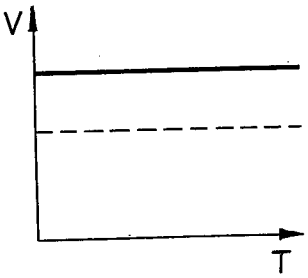
FIGS. 10A to 10C graphically illustrate relationships between a receiving signal and a reference signal.
Figure 10B:
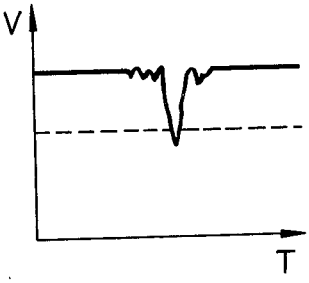
Figure 10C:
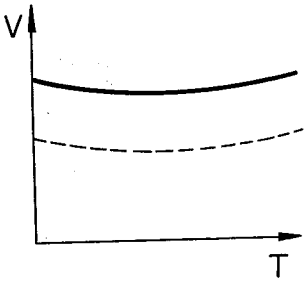

Generally, the level of a receiving signal when the receiver receives the transmitting wave, is constant as indicated by a continuous line in FIG. 10A. When an object interrupts the microwave between the transmitting and receiving sections, the receiving level changes as shown in FIG. 10B. The warning apparatus constantly compares the receiving level with a low reference level as indicated by a broken line in the figure. When both the levels are coincident with each other, the apparatus judges that there is an intruding object. The microwave signal received by the receiver generally varies depending on ambient conditions such as rain, snow or temperature. To take a countermeasure for this, the audio frequency amplifier 24 for amplifying the detecting output signal in the receiving section is provided with AGC circuit 26. The AGC circuit 26 has a large time constant in order to distinguish a rapid level reduction due to the presence of the intruding object from a slow level reduction due to the change of the ambient condition. For this reason, where the receiving level slowly varies according to a heavy rain or snowstorm or rapidly varies according to a rapid variation of the temperature, the AGC circuit 26 can't follow the level variation of the receiving signal. It is for this reason that the present embodiment employs the reference signal generator 30 with the same time constant as that of the AGC circuit 26, thereby to change, as shown in FIG. 10C, the reference level in accordance with the ambient condition change, as in the case of the receiving signal. In FIGS. 10A to 10C, the abscissa represents time and the ordinate represents a signal voltage level. Therefore, even if the receiving level reduces due to the ambient condition change, the warning apparatus according to the invention may make a detection of the intruding object with a high reliability, being free from an erroneous detection.

Also in the receiving section, if the signal take-out portion for taking out a signal from the detector diode 98 is provided without little projection from the waveguide 81, the receiving section may be made small in size and light in weight, as in the case of the transmitting section. In this case, a capacitor is formed by sandwiching the insulating plate 108 between the surface of the waveguide 81 and the metal plate 110. The capacitor is almost in the short-circuited state in the frequency band of the microwave and is almost in the insulated state at DC or low frequencies. Accordingly, the detector output may be effectively taken out.

As described above, the present invention may provide a warning apparatus using microwaves which is small in size and light in weight and free from an erroneous detection.

What we claim is:

1. A warning apparatus using microwaves comprising:

drive means generating a rectangular pulse voltage;

means for oscillating a microwave in accordance with the rectangular pulse voltage generated from said drive means;

a transmission antenna having a first rectangular slotted waveguide and a horn which are arranged in a horizontal plane, for radiating in accordance with the microwave from said oscillating means a fan beam whose width is broad in a vertical plane;

a receiving antenna having a second rectangular slotted waveguide and a horn;

means for detecting a microwave with a given frequency band received by said receiving antenna;

an automatic gain control circuit connected to said detecting means and having a given time constant to control a gain of said detecting means;

reference signal generating means having a time constant the same as the time constant of said automatic gain control circuit and generating a reference signal according to the output signal of said detecting means; and means for comparing the output signals of said detecting means and reference signal generating means to produce a detecting signal when both signals coincide with each other.

2. A warning apparatus according to claim 1, wherein said drive means includes a power source terminal, a pulse generator, a transistor which is connected at the base to the output terminal at said pulse generator and at the emitter to ground, a Zener diode which is connected at the cathode to the collector of said transistor and at the anode to the emitter of said transistor, and a three-terminal voltage regulator which is connected at a power source terminal to said power source terminal, at a ground terminal to the collector of said transistor, and an output terminal to said oscillating means.

3. A warning apparatus according to claim 1, wherein said oscillating means has a flange with an opening at the center, said first slotted waveguide has a coupling hole at one side, and said oscillating means is coupled with said first slotted waveguide in a manner that the opening of said flange of said oscillating means is aligned with the coupling hole of said first slotted waveguide and, by using a mounting member with a hollow for accommodating said first slotted waveguide therein in which both fringes of said mounting member defining the hollow are extended outwardly, the waveguide is sandwiched by said fringes and said flange of said oscillating means.

4. A warning apparatus according to claim 1, wherein said detecting means includes a diode, and second slotted waveguide has an opening on one side thereof to allow said diode to pass therethrough and on the other side opposite to the former side a second opening which is smaller than said first opening and allows an electrode pin of said diode to pass therethrough, wherein in mounting said diode to said second slotted waveguide, said diode is inserted into said second slotted waveguide through said first opening, one of the electrodes projecting from said second opening is fixed by a spring plate with a slot at the center while said second opening is covered with said spring plate, and the other electrode projecting from said first opening is fixed by a spring plate with a slot at the center through an insulating plate and a metal capacity plate, while said first opening is covered with those plates, wherein said capacity plate includes a terminal through which the output signal from said detecting means is taken out.

5. A warning apparatus using microwaves comprising:

means for oscillating a microwave in accordance with an applied voltage;

drive means for applying a rectangular pulse voltage to said oscillating means;

a transmission antenna having a first rectangular slotted waveguide and a horn which are for radiating an output signal from said oscillating means;

a receiving antenna having a second rectangular slotted waveguide and a horn;

filter means for allowing only a microwave with a given frequency band of microwaves received by the receiving antenna to pass therethrough;

means for detecting the output signal from said filter means;

means for generating a reference signal according to the output signal from said filter means; and comparing means which compares the output signals from said detecting means and said reference signal generating means thereby to produce a detecting signal according to a difference therebetween;

wherein said drive means includes a power source terminal, a pulse generator, a transistor which is connected at the base to the output terminal at said pulse generator and at the emitter to ground, a Zener diode which is connected at the cathode to the collector of said transistor and at the anode to the emitter of said transistor, and a three-terminal voltage regulator which is connected at a power source terminal to said power source terminal at a ground terminal to the collector of said transistor, and an output terminal to said oscillating means.

6. A warning apparatus using microwaves comprising:

means for oscillating a microwave in accordance with an applied voltage;

drive means for applying a rectangular pulse voltage to said oscillating means;

a transmission antenna having a first rectangular slotted waveguide and a horn which are for radiating an output signal from said oscillating means;

a receiving antenna having a second rectangular slotted waveguide and a horn;

filter means for allowing only a microwave with a given frequency band of microwaves received by the receiving antenna to pass therethrough;

means for detecting the output signal from said filter means;

means for generating a reference signal according to the output signal from said filter means; and comparing means which compares the output signals from said detecting means and said reference signal generating means thereby to produce a detecting signal according to a difference therebetween;

wherein said oscillating means has a flange with an opening at the center, said first slotted waveguide has a coupling hole at one side, and said oscillating means is coupled with said first slotted waveguide in a manner that the opening of said flange of said oscillating means is aligned with the coupling hole of said first slotted waveguide and, by using a mounting member with a hollow for accommodating said first slotted waveguide therein in which both fringes of said mounting member defining the hollow are extended outwardly, the waveguide is sandwiched by said fringes and said flange of said oscillating means.

* * * * *

UNITED STATES PATENT AND TRADEMARK OFFICE

CERTIFICATE OF CORRECTION

PATENT NO. : 4,334,214

DATED : June 8, 1982

INVENTOR(S) : SHUN SATOU ET AL.

It is certified that error appears in the above—identified patent and that said Letters Patent is hereby corrected as shown below:

On the title page insert Foreign Application Priority Data:

[30] -- Foreign Application Priority Data

June 29, 1979 [JP] Japan.....89413/79

April 28, 1980 [JP] Japan.....59016/80

April 28, 1980 [JP] Japan.....59017/80

April 28, 1980 [JP] Japan.....59018/80

April 28, 1980 [JP] Japan.....56874/80 --

Signed and Sealed this

*Thirty-first* Day of *August 1982*

[SEAL]

*Attest:*

GERALD J. MOSSINGHOFF

*Attesting Officer*

*Commissioner of Patents and Trademarks*